US008108953B2

(12) United States Patent
Zeng

(10) Patent No.: US 8,108,953 B2
(45) Date of Patent: Feb. 7, 2012

(54) TOILET WARM WATER AND AIR EJECTION DEVICE

(76) Inventor: Pin Zeng, Vernon Hills, IL (US)

( * ) Notice: Subject to any disclaimer, the term of this patent is extended or adjusted under 35 U.S.C. 154(b) by 376 days.

(21) Appl. No.: 12/509,470

(22) Filed: Jul. 26, 2009

(65) Prior Publication Data

US 2011/0016624 A1 Jan. 27, 2011

(51) Int. Cl.

| | |
|---|---|
| ***A47K 3/22*** | (2006.01) |
| ***A47K 3/26*** | (2006.01) |
| ***A61H 35/00*** | (2006.01) |
| ***E03D 11/02*** | (2006.01) |
| ***E03D 9/08*** | (2006.01) |

(52) U.S. Cl. ..... 4/420.2; 4/420.4; 4/448

(58) Field of Classification Search ..... 4/420.2, 4/420.4, 448

See application file for complete search history.

(56) References Cited

U.S. PATENT DOCUMENTS

| | | | | |
|---|---|---|---|---|
| 4,926,509 | A * | 5/1990 | Bass | 4/448 |
| 5,384,919 | A * | 1/1995 | Smith | 4/448 |
| 5,933,881 | A * | 8/1999 | Smith | 4/420.4 |
| 6,167,577 | B1 * | 1/2001 | Hammad | 4/420.4 |
| 6,618,865 | B1 * | 9/2003 | Kim | 4/420.4 |
| 7,013,502 | B2 * | 3/2006 | Pacheco | 4/420.2 |
| 7,322,055 | B2 * | 1/2008 | Takenaga | 4/420.2 |

* cited by examiner

*Primary Examiner* — Tuan Nguyen

(57) ABSTRACT

The Toilet Warm Water and Air Ejection Device is a sanitary device for the flush toilets. People can use this device to wash and then dry up their anus area using warm water jet and warm air jet after they used the toilet. The concept of this device can be used for new toilet designs. The device is simple and can also be used as an added on system to install onto existing toilets. A close up PTC water heater is integrated into the device to produce fast available warm water. An electric air heater (hair dryer for example) is used to provide warm air. Two moveable nozzles (tied-together) are used for ejecting warm water and air. During washing process, one nozzle ejects warm water. During drying up process, both nozzles eject warm air. The moveable nozzles can be rotated out of the toilet after they are used.

3 Claims, 9 Drawing Sheets

The device is in in-use position

The device is in in-use position

The device is in non-use position

Detailed partial view of the Toilet Warm Water and Air Ejection Device

Assembled view of some water and air passages

Mounting Bracket

Mounting Shaft

Rotation Sleeve for Air Nozzle

Rotation Sleeve for Water/Air Nozzle

3-Way Ball Valve

Notes:

The 3-way ball valve would not open air and water at same time.

It closes water and then opens the air or closes air and then opens the water.

PTC (Positive Temperature Coefficient) Water Heater

TOILET WARM WATER AND AIR EJECTION DEVICE

REFERENCES CITED

| U.S. Patent Documents | | |
|---|---|---|
| 4,926,509 | May, 1990 | Bass |
| 5,384,919 | January 1995 | Smith |
| 5,933,881 | August 1999 | Smith |
| 6,167,577 | January 2001 | Hammad |
| 6,618,865 | September 2003 | Kim |
| 7,013,502 | March 2006 | Pacheco |
| 7,322,055 | January 2008 | Takenaga |

BACKGROUND OF THE INVENTION

For the people who already have some kind of anus diseases, using dry toilet paper can be painful. The device can alleviate their pains by water cleaning/air drying their anus area and help healing their diseases. For the people who don't have any anus diseases, this device can be used to achieve better cleaning effects and help prevent various anus diseases to improve health.

This device is simple and can be manufactured inexpensively. It has the potential of "one size fit all" for installation onto different flush toilets. The installation of the device is also easy. It provided possibility for more people to own and use such a sanitary device.

The inexpensive devices that fulfill the similar purpose as those listed in the "References Cited" usually left part of their devices such as nozzles inside the toilet. The present invention provides a device that after the two nozzles are rotated out of toilet, there will be no added obstructions in the toilet to prevent thorough cleaning to the toilet. Basically, after the two nozzles are rotated out of toilet, the toilet returns to its original form.

SUMMARY OF THE INVENTION

The first objective of the present invention is to provide a simple, low cost and easy to install device for people to wash and then dry up their anus area using warm water jet and warm air jet when they use the flush toilets.

The second objective of the present invention is to provide a device that is easy to use. The user can follow the steps below to use the device.

1. Plug in the powers for the PTC water heater and electric air heater (hair dryer for example), which will start to warm up the water heater and make the air heater ready to use
2. Use the toilet as a conventional flush toilet and then flush the toilet
3. Stand up to rotate the nozzles from non-use position outside of the toilet to the in-use position inside the toilet and then seat back down on toilet seat
4. Turn the 3-way ball valve to close the air passage and open the water passage to the water/air nozzle to eject warm water to wash their anus area
5. After the washing, turn the 3-way ball valve to open the air passage and close the water passage to the water/air nozzle to stop ejecting warm water
6. Turn on air heater (hair dryer for example) to eject warm air from both water/air nozzle and air nozzle to dry up their anus area 7. After the drying up, turn off the air heater to stop ejecting warm air
7. Stand up to rotate the nozzles from in-use position inside toilet to the non-use position outside of the toilet and then flush the toilet and close the toilet seat cover
8. Unplug the powers for the PTC water heater and electric air heater The third objective of the present invention is to provide a device with reasonably good performance through following design considerations.

1. By using a close-up PTC water heater, the device can make warm water available for ejection rapidly. It also avoids plumbing work of connecting the house hot water to the device and helps to further simplify the installation.
2. In the device, two nozzles are used for water and air ejections (FIGS. 1 to 4). One nozzle (the water/air nozzle) is used for ejecting warm water during washing. Both nozzles (the water/air nozzle and air nozzle) are used for ejecting warm air during drying up. In this way, it achieves following benefits:
   - 2.1 Because the water density is much larger than that of air, water ejection requires smaller diameter nozzle to produce strong water jet for better cleaning and air ejection requires larger flow cross section area for faster drying up. The two nozzle design will meet the requirements for both water and air ejections, small diameter nozzle for water ejection and large flow cross section area of both nozzles for air ejection.
   - 2.2 The residual water in the water/air nozzle left from water ejection will be evacuated by the warm air ejection. The water/air nozzle will also be dried up by the warm air flow through it.

The fourth objective of the present invention is to provide a safe to use device through following design considerations.

1. By using a close-up PTC water heater (FIGS. 1, 2, 3 and 10), the peak water temperature from the PTC water heater is limited and can not burn its user with hot water. The PTC water heater will not get overheated and damaged even if it is left on power all the time. The surface temperature of the heating material in the PTC water heater will stay at its designed value, for example 50° C. A LED power indicator on the PTC water heater (FIG. 10) will remind the user to turn off the heater after it is used.
2. By making the forward portions of the two nozzles using elastic materials, it helps to avoid injuring the user in-case the nozzles are not rotated to the correct position and the user seats on it accidentally. It also avoids damaging the device in the same time.
3. The design has guaranteed that the water passage will be automatically closed (except for the leakage) when the 2 nozzles are rotated to outside of the toilet even if the user did not totally shut the water or the 3-way ball valve is stuck and can not shut the water. It automatically prevents spraying large amount of water outside the toilet.

The fifth objective of the present invention is to provide a "one size fit all" device for different flush toilet. The extended long mounting holes on the mounting bracket as shown in FIG. 5 and the flexibility gained by using elastic materials for the forward portions of the two nozzles help to achieve this objective.

The sixth objective of the present invention is to provide a device that can be totally removed (rotated) out of toilet so that it will not add obstructions in the toilet to prevent thorough cleaning to the toilet. It allows the toilet be covered with toilet seat cover after each use. Basically, after the two nozzles are rotated out of toilet, the toilet returns to its original form.

If the present invention can be put into industrial production, the pipelines and the wires can be rearranged and a nice looking cover can be designed to give it a better appearance.

DETAILED DESCRIPTION OF THE INVENTION

Figure 1:
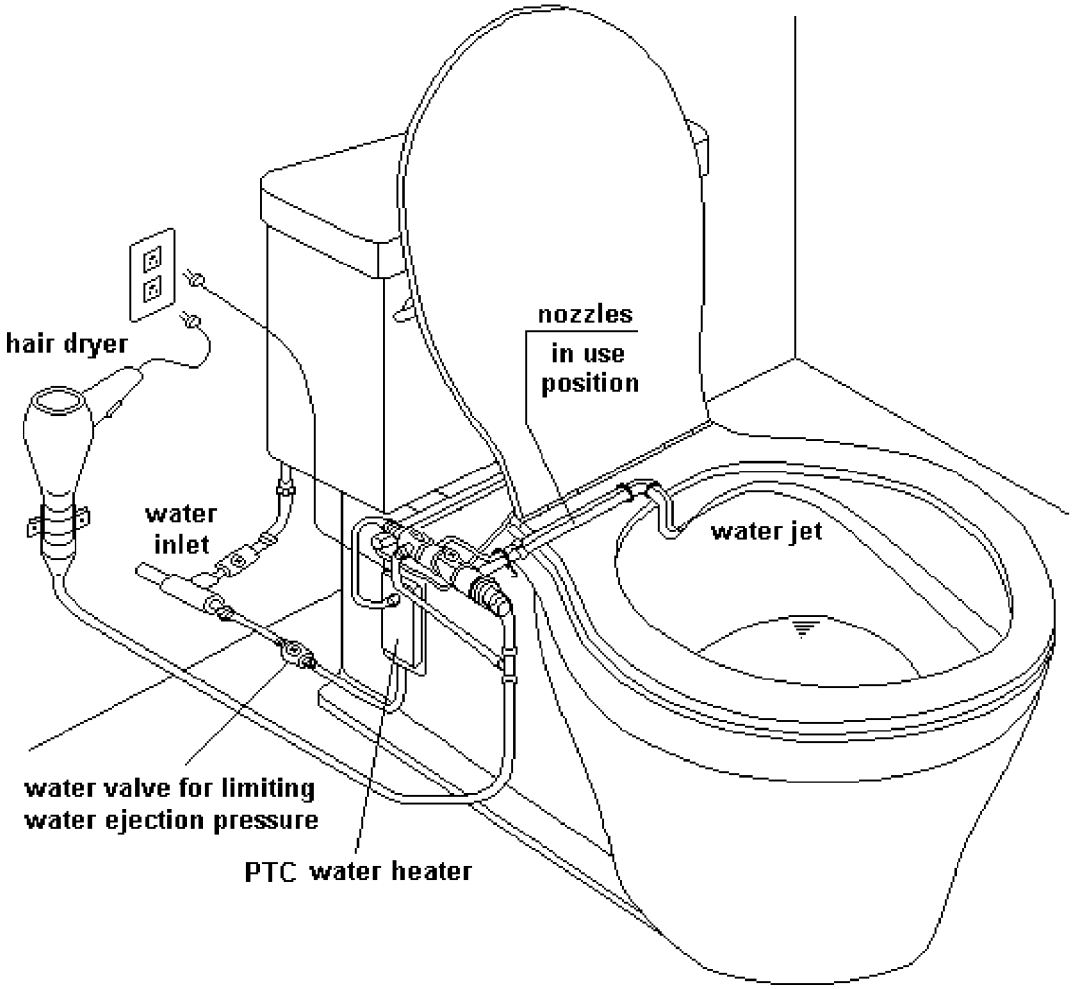
FIG. 1 shows a schematic view of the present invention when it is in in-use position.
Figure 2:
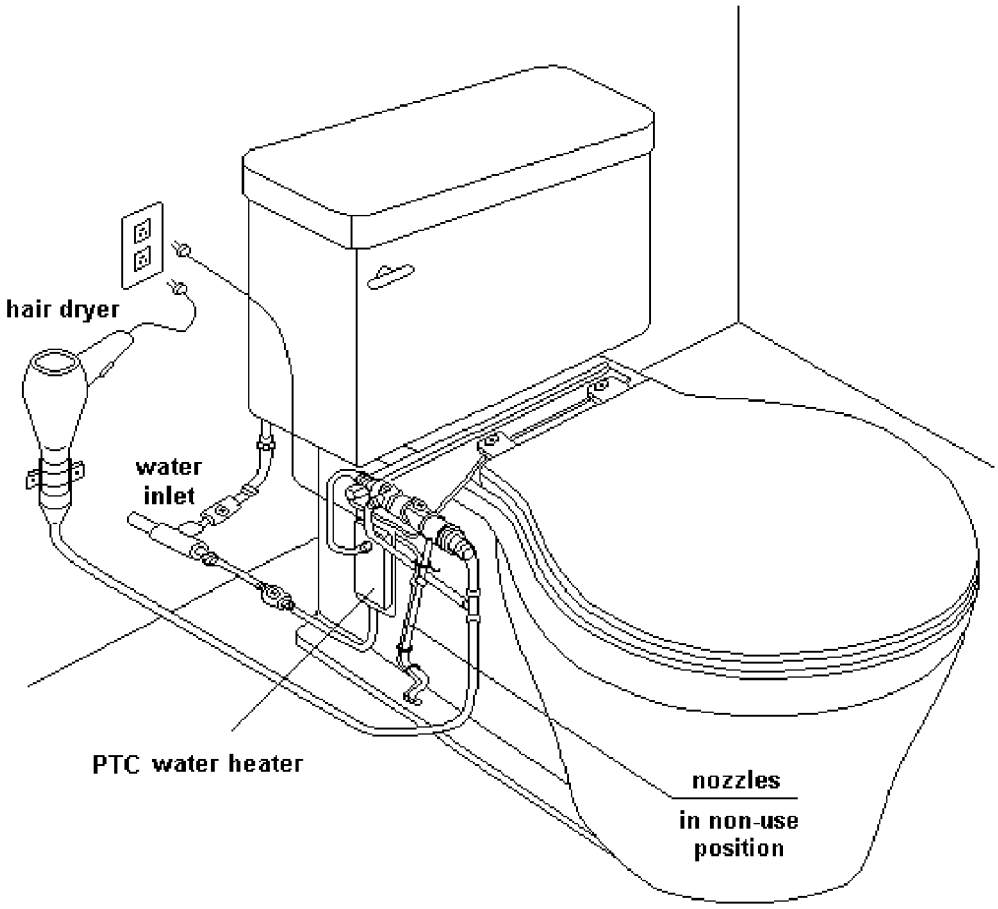
FIG. 2 shows a schematic view of the present invention when it is in non-use position.
Figure 3:
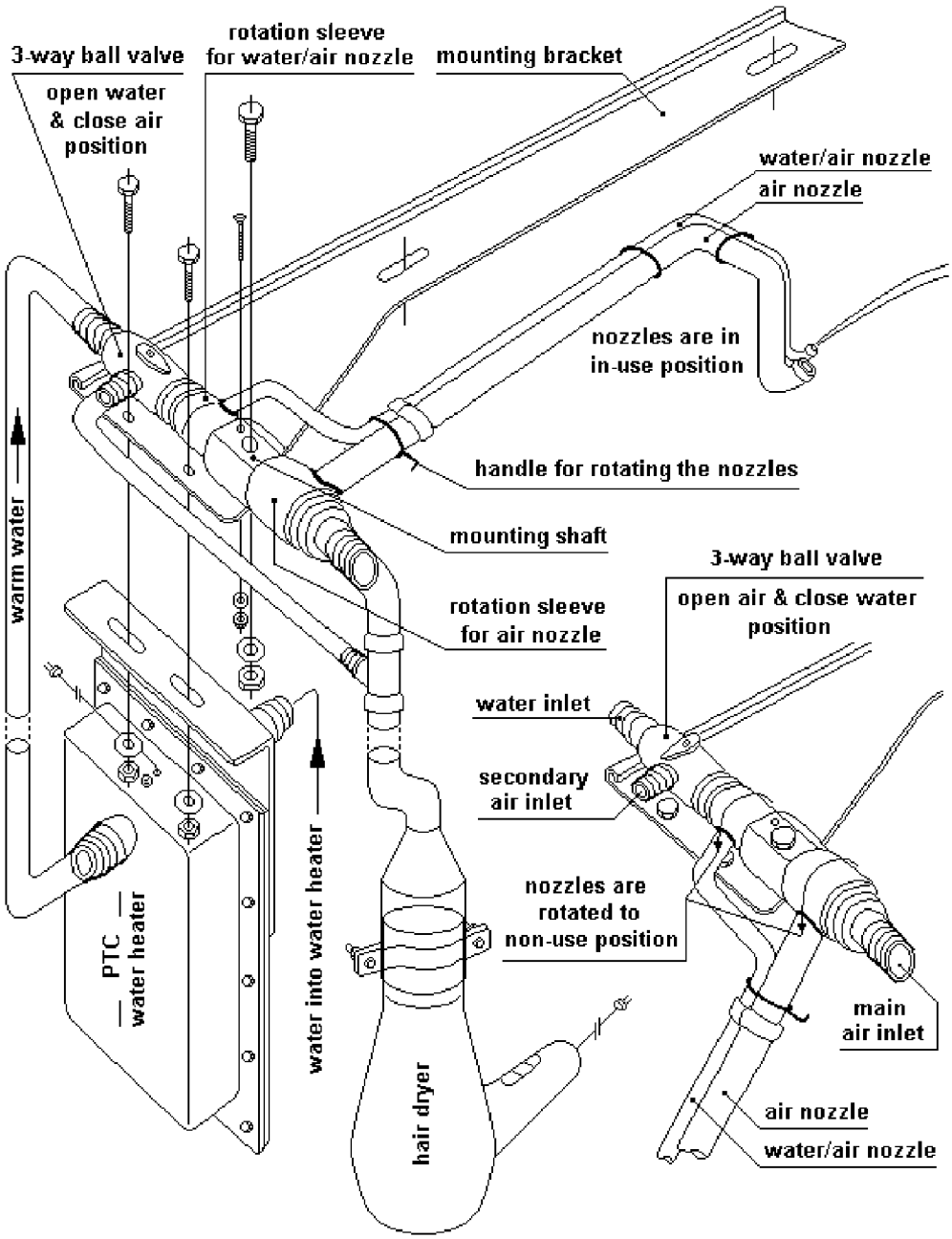
FIG. 3 shows a detailed partial view of the present invention when it is in in-use position and a detailed partial view of the present invention when it is in non-use position.
Figure 4:
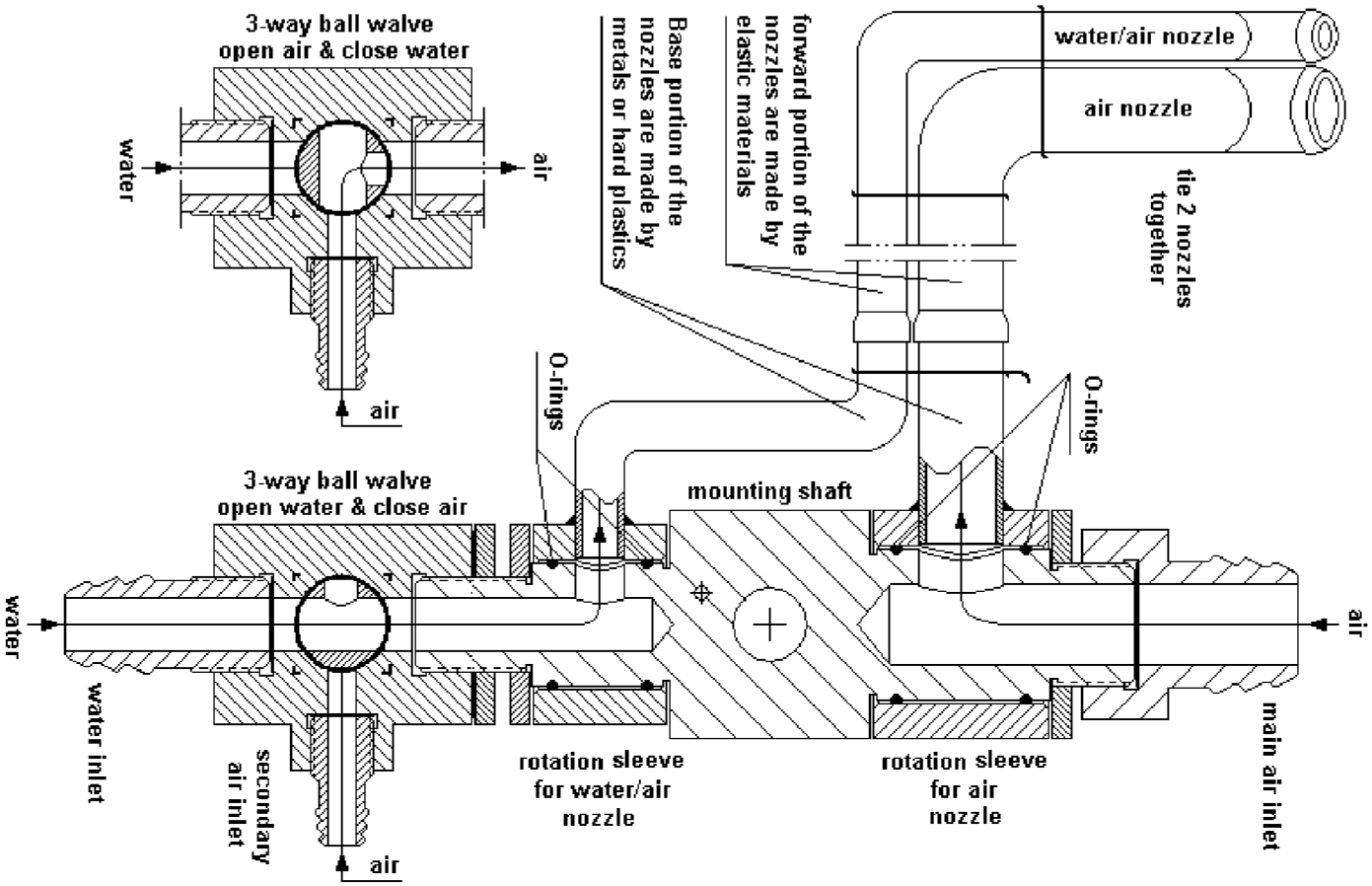
FIG. 4 shows some air and water passages in an assembled view of the present invention
Figure 5:
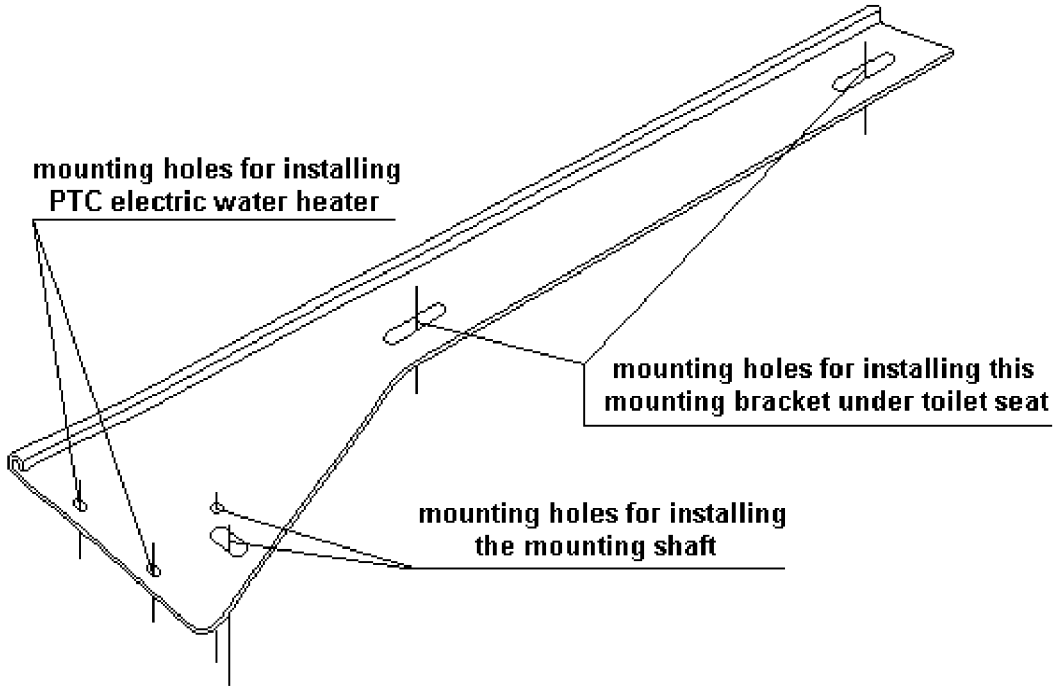
FIG. 5 shows the "Mounting Bracket" and the installation holes on it for the present invention.
Figure 6:
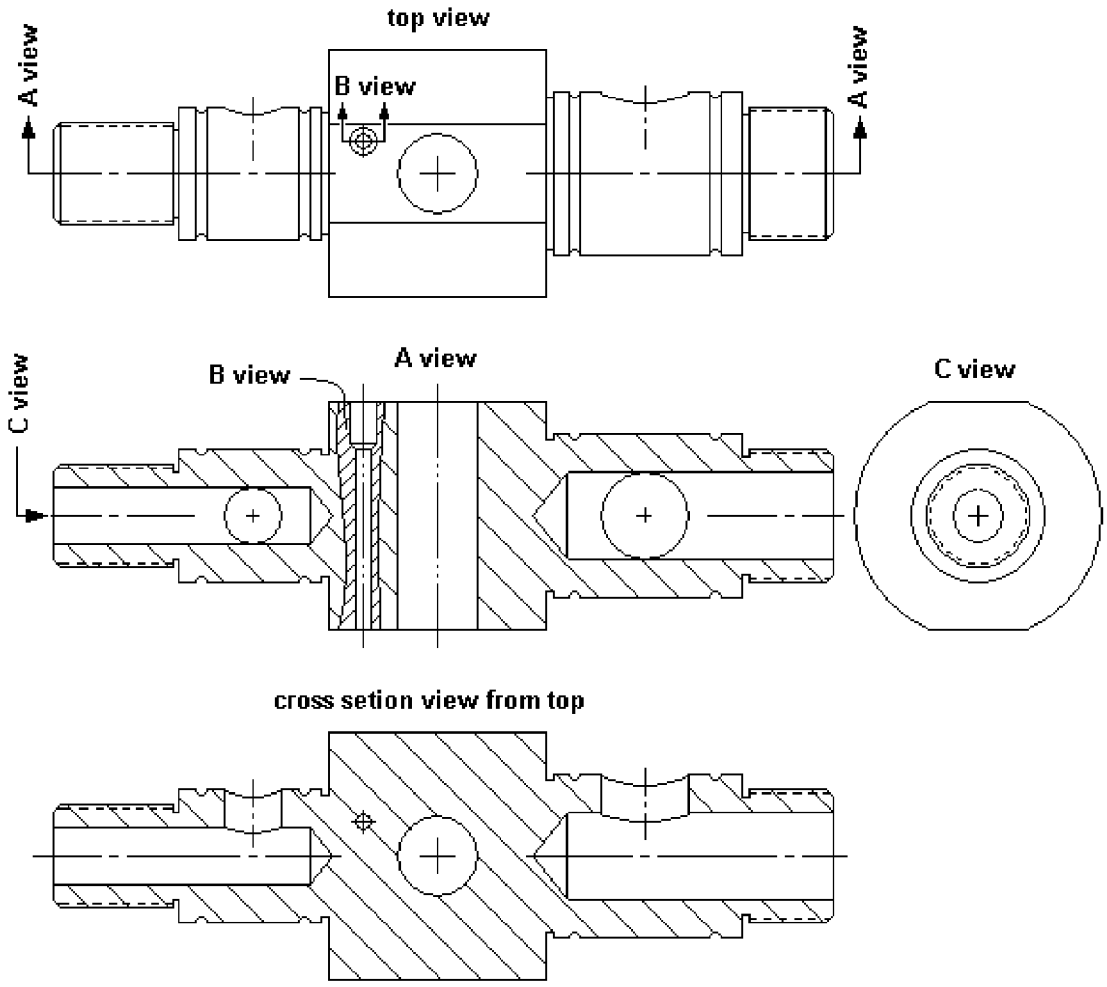
FIG. 6 shows the different views of the "Mounting Shaft" for the present invention.
Figure 7:
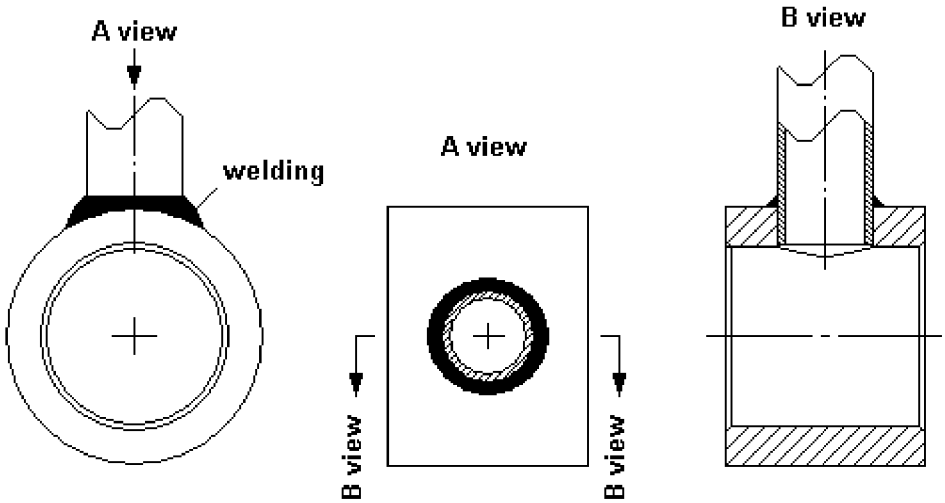
FIG. 7 shows the different views of the "Rotation Sleeve for Air Nozzle" for the present invention.
Figure 8:
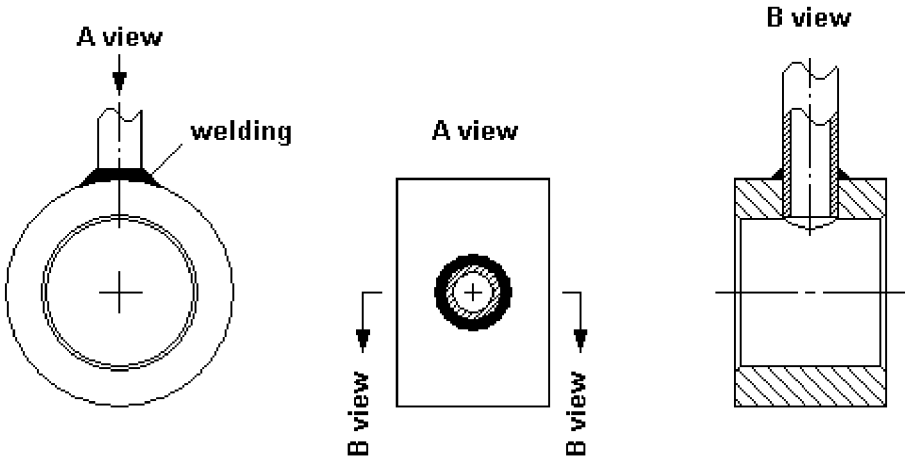
FIG. 8 shows the different views of the "Rotation Sleeve for Water/Air Nozzle" for the present invention.
Figure 9:
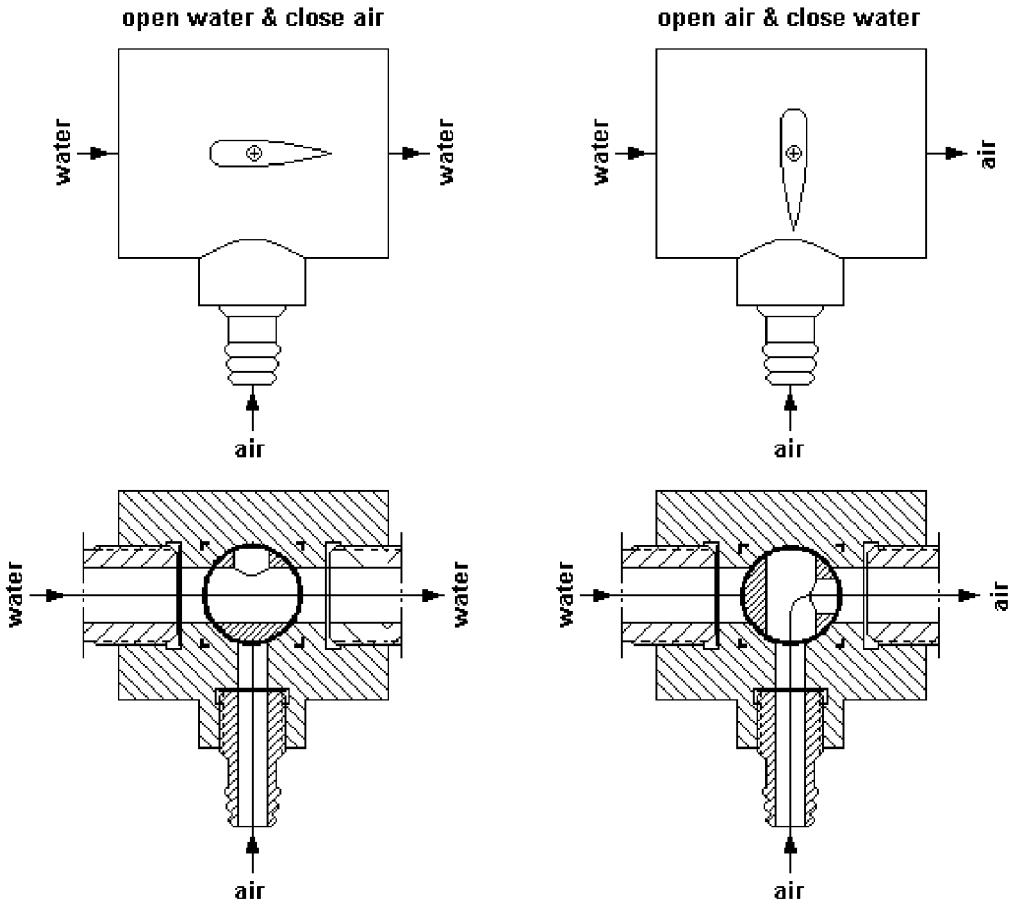
FIG. 9 shows the "3-Way Ball Valve" at its "open air & close water" and "open water & close air" positions for the present invention.
Figure 10:
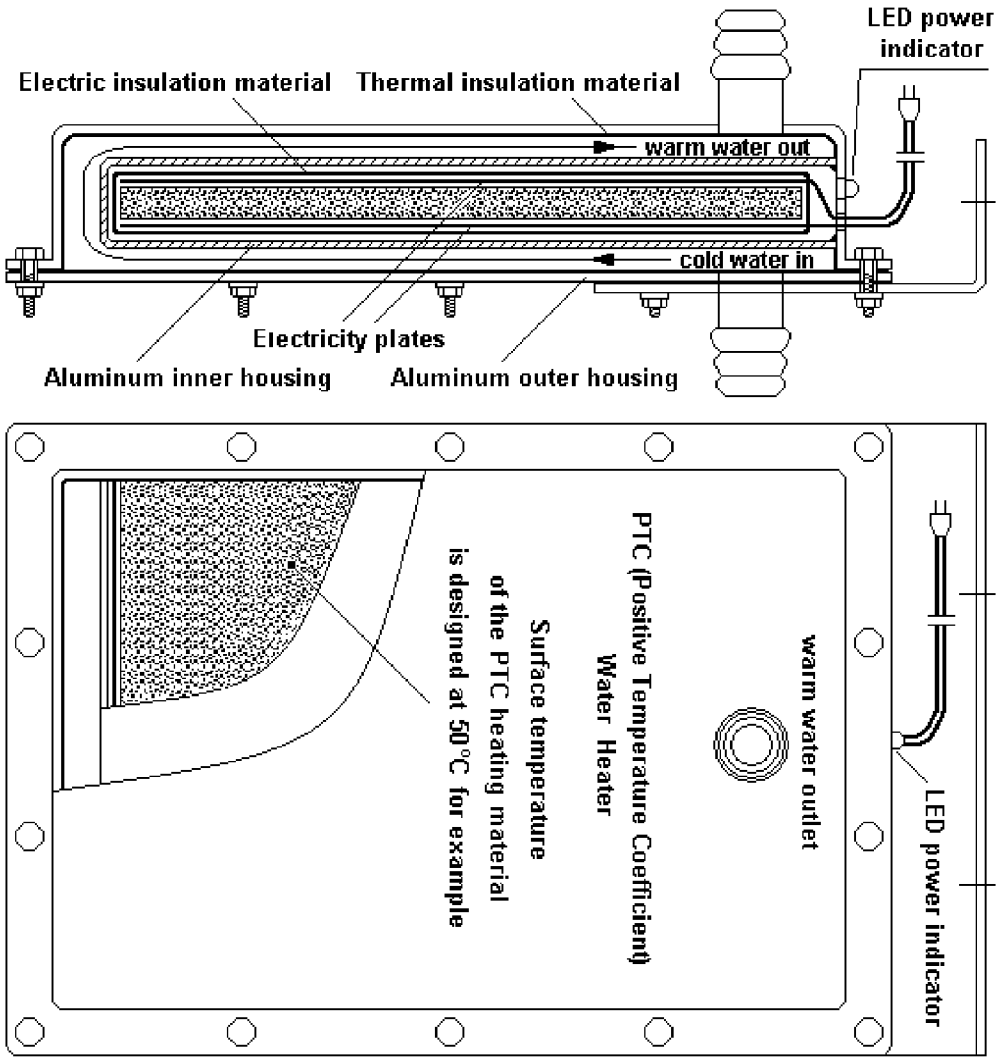
FIG. 10 shows the illustrations of the "PTC Water Heater" that can be used for the present invention.

1. The device comprises a mounting bracket, a mounting shaft, a rotation sleeve for water/air nozzle, a rotation sleeve for air nozzle, a water/air nozzle, an air nozzle, a water valve for limiting water ejection pressure, a 3-way ball valve, a PTC water hater, an electric air heater (hair dryer for example) and accessories such as pipes, pipe connectors (inlet and T type connectors), electric wires, power connectors, bolts, nuts, washers and O rings.
   FIGS. 1, 2 and 3 illustrate the assembled system of this device at in-use and non-use positions. FIG. 4 indicates the water and air paths led to the nozzles. FIGS. 5, 6, 7, 8, 9 and 10 show the major parts of the device.
   The device is can be described as following:
   1.1 The mounting bracket (FIG. 5) is installed under the toilet seat using toilet seat mounting bolts and nuts through 2 mounting holes as shown in FIGS. 1 to 3.
   1.2 The mounting shaft (FIG. 6) is fastened onto the mounting bracket through 2 mounting holes, a larger one and a smaller one as shown in FIG. 3.
   1.3 The air nozzle is made up of two portions, the forward portion and the base portion. The forward portion is made with elastic materials and the base portion is made with metals as shown in FIG. 4 or hard plastics. The elastic materials for making the forward portion of the nozzle need to be hard enough to maintain the shape and elastic enough to have certain flexibility. The base portion of the air nozzle is welded onto the rotation sleeve for air nozzle (FIGS. 4 and 7).
   1.4 The rotation sleeve for air nozzle (FIG. 7) is assembled onto the mounting shaft on the larger diameter side as shown in FIG. 4. It can rotate around the mounting shaft. Two O-rings are used for sealing the air leakage between the rotation sleeve and the mounting shaft as shown in FIG. 4. Then, this side of the mounting shaft is connected to the main air inlet also shown in FIG. 4.
   1.5 The water/air nozzle is made up from two portions, the forward portion and the base portion. The forward portion is made with elastic materials and the base portion is made with metals as shown in FIG. 4 or hard plastics. The elastic materials for making the forward portion of the nozzle need to be hard enough to maintain the shape and elastic enough to have certain flexibility. The base portion of the water/air nozzle is welded onto the rotation sleeve for water/air nozzle (FIGS. 4 and 8).
   1.6 The rotation sleeve for water/air nozzle (FIG. 8) is assembled onto the mounting shaft at the smaller diameter side as shown in FIG. 4. It can rotate around the mounting shaft. Two O-rings are used for sealing the water/air leakage between the rotation sleeve and the mounting shaft as shown in FIG. 4. Then, this side of the mounting shaft is connected to a 3-way ball valve that is further connected a secondary air inlet and a water inlet also shown in FIG. 4.
   1.7 When the device is going to be used, the two nozzles will be rotated from their non-use position outside the toilet (FIGS. 2 and 3) to their in-use position (FIGS. 1 and 3) using the handle for rotating the nozzle (FIG. 3). The tips of the 2 nozzles will be rotated to inside of the toilet and aimed at people's anus area as shown in FIG. 1.
   1.8. A 3-way ball valve is used to control the flows in the water/air nozzle (FIGS. 4 and 9) when the two nozzles are rotated to their in-use position inside the toilet. When the 3-way ball valve is turned to "open water & close air" position, it opens the water path and close the air path to the water/air nozzle. The warm water will be ejected out from the tip of the water/air nozzle for washing people's anus area. The warm water flow rate and ejection pressure can be adjusted by the opening of the 3-way ball valve. A water valve is used for limiting the water ejection pressure (FIG. 1). When the 3-way ball valve is turned to "open air & close water" position, it opens the air path and close the water path to the water/air nozzle.
   1.9 A PTC water heater (FIGS. 1, 2, 3 and 10) is installed under one end of the mounting bracket to become a close-up warm water source for the device.
   1.10 An electric air heater (hair dryer for example) (FIGS. 1, 2 and 3) is used to supply warm air for the device when it is turned on. The warm air is split into 2 paths using a T type connector and then sent to main air inlet and secondary air inlet (FIGS. 1 to 4) through pipes. When the two nozzles are in their in-use position inside the toilet and the 3-way ball valve is turning to "open air & close water" position, the electric air heater can be turned on and the warm air will be ejected out from the tips of the two nozzles (air nozzle and water/air nozzle) for drying up people's anus area. The temperature and the flow rate of the warm air can be adjusted by the electric air heater (hair dryer for example) in some range. After drying up, the electric air heater should be turned off. The 2 nozzles can be rotated from their in-use position (FIGS. 1 and 3) to their non-use position (FIGS. 2 and 3) using the handle for rotating the nozzles (FIG. 3). Then, the toilet cover can be put back.
2. In the device described in 1, the major parts of the system will be mounted on the mounting bracket, which is installed under the toilet seat using toilet seat mounting bolts and nuts through 2 mounting holes as shown in FIGS. 1 to 3. The device shares the water supply line with the toilet using a T type connector as shown in FIGS. 1 and 2.
3. In the device described in 1, two nozzles for water and air ejections can be manually rotated into toilet and rotated out from toilet (FIGS. 1, 2 and 3). Only when the two nozzles are rotated to the in-use position in the toilet, the passages of the two nozzles can get aligned with the passages in the mounting shaft (FIG. 4) and the water and air paths can be totally opened. After use, the two nozzles will be rotated out from the toilet (FIGS. 2 and 3). When the two nozzles are rotated out of the toilet, the passages of the two nozzles will not get aligned with the passages in the mounting shaft (FIG. 4) and the water and air passages are automatically closed (except for the leakages).

What is claimed is:

1. A toilet warm water and air ejection device comprising:

a mounting bracket installed under toilet seat with toilet seat bolts and nuts, a mounting shaft with inside water and air passages fastened on the mounting bracket, two rotation sleeves mounted on the mounting shaft and can rotate around the mounting shaft, a water/air nozzle and an air nozzle with hard base portions extruding from the two rotation sleeves and elastic forward portions for water and air ejections, a water valve for limiting water ejection pressure a three-way ball valve connected on one end of the mounting shaft controlling the opening and closing of the water and air passages for the water/air nozzle, a PTC water heater installed under one end of the mounting bracket generating fast available warm water, an electric air heater comprises a hair dryer for generating warm air, and accessories comprises pipes, pipe connectors including inlet connectors and T-type connectors, electric wires, power connectors, bolts, nuts, washers and O-ring.

2. The toilet warm water and air ejection device of claim 1, wherein said the water/air nozzle ejects warm water during washing and both the water/air nozzle and the air nozzle eject warm air during drying up.

3. The toilet warm water and air ejection device of claim 1, wherein said water/air nozzle and said air nozzle can be rotated from non-use position outside of the toilet to the in-use position inside the toilet.

* * * * *